US006724284B2

(12) United States Patent
Simms et al.

(10) Patent No.: US 6,724,284 B2
(45) Date of Patent: Apr. 20, 2004

(54) CIRCUIT BREAKER

(75) Inventors: Kevin Anthony Simms, Houston, PA (US); Jeffery Wayne Lockhart, Pittsburgh, PA (US); Wayne Gerald Adamson, Coraopolis, PA (US)

(73) Assignee: Eaton Corporation, Cleveland, OH (US)

( * ) Notice: Subject to any disclaimer, the term of this patent is extended or adjusted under 35 U.S.C. 154(b) by 199 days.

(21) Appl. No.: 09/776,602

(22) Filed: Feb. 2, 2001

(65) Prior Publication Data

US 2002/0105771 A1 Aug. 8, 2002

(51) Int. Cl.[7] ..... H01H 75/00

(52) U.S. Cl. ..... 335/14; 335/20; 335/172; 335/202

(58) Field of Search ..... 335/14, 20, 166–176, 335/132, 202

(56) References Cited

U.S. PATENT DOCUMENTS

| | | | | |
|---|---|---|---|---|
| 4,947,145 A | * | 8/1990 | Ohishi et al. | 335/14 |
| 5,172,086 A | * | 12/1992 | Fujihisa et al. | 335/14 |
| 5,291,165 A | | 3/1994 | Whipple et al. | |
| 5,301,083 A | | 4/1994 | Grass et al. | |
| 5,373,411 A | | 12/1994 | Grass et al. | |
| 5,552,755 A | | 9/1996 | Fello et al. | |
| 5,856,643 A | | 1/1999 | Gress, Jr. et al. | |
| 5,907,461 A | | 5/1999 | Hartzel et al. | |
| 6,040,746 A | | 3/2000 | Maloney et al. | |
| 6,104,265 A | | 8/2000 | Maloney et al. | |

FOREIGN PATENT DOCUMENTS

JP 6-251686 * 6/1994

* cited by examiner

*Primary Examiner*—Lincoln Donovan
(74) *Attorney, Agent, or Firm*—Martin J. Moran

(57) ABSTRACT

A circuit breaker includes a housing, separable contacts, an operating mechanism having a pivotally mounted operator handle for opening and closing the separable contacts, and a trip mechanism releasing the operating mechanism to move the operator handle to its tripped position. A micro-switch includes an actuator lever movable between an actuated position and a non-actuated position and adapted to engage a surface of the operator handle. The micro-switch also includes a normally open contact having a closed state corresponding to the actuated position and an open state corresponding to the non-actuated position. The operator handle surface engages and moves the actuator lever to the actuated position in only the ON position of the operator handle. The actuator lever is in the non-actuated position in the OFF position and the tripped position of the operator handle.

13 Claims, 12 Drawing Sheets

CIRCUIT BREAKER

CROSS-REFERENCE TO RELATED APPLICATIONS

This application is related to commonly owned, copending U.S. patent application Ser. No. 09/514,458, filed Feb. 28, 2000, entitled "Remotely Controllable Circuit Breaker"; and commonly owned, concurrently filed U.S. patent application Ser. No. 09/776,235, filed Feb. 2, 2001, entitled "Circuit Breaker and Electrical Distribution Panel Employing the Same," now U.S. Pat. No. 6,538,870.

BACKGROUND OF THE INVENTION

1. Field of the Invention

This invention relates to circuit breakers for protecting electric power circuits and, more particularly, to such circuit breakers including separable contacts, an operating mechanism and a switch, such as a micro-switch, which follows the ON, tripped and OFF states of the operating mechanism.

2. Background Information

Circuit breakers are used to protect electrical circuitry from damage due to an overcurrent condition, such as an overload condition or a relatively high-level short circuit condition.

Circuit breakers used in residential and light commercial applications are commonly referred to as miniature circuit breakers because of their limited size. Such circuit breakers typically have a pair of separable contacts opened and closed by a spring biased operating mechanism. A thermal-magnetic trip device actuates the operating mechanism to open the separable contacts in response to persistent overcurrent conditions and to short circuits.

Circuit breakers typically provide status feedback by a visual indication only (e.g., by the position of the circuit breaker handle, by an indication window).

Some circuit breakers employ a status contact for reporting the status of the circuit breaker's separable contacts. For example, electrical switching devices may optionally include an auxiliary connection or an auxiliary switch located therein to externally indicate the status of the device. Such an auxiliary connection may include, for example, a connection from an internal auxiliary switch to a bell alarm and/or other external circuits for enunciating and/or monitoring the open/closed/tripped status of the electrical switching device.

U.S. Pat. Nos. 5,301,083 and 5,373,411 describe a remotely operated circuit breaker, which introduces a second pair of switching relay contacts in series with the main separable contacts. The main contacts still interrupt the overcurrent, while the secondary contacts perform the discretionary switching operations (e.g., load shedding). The secondary contacts are opened by a solenoid, which is spring biased to close the contacts. Feedback circuitry, including normally open and normally closed auxiliary feedback contacts, provides a status indication of the condition of the secondary contacts.

Known circuit breakers of such types only provide the status of the switching contacts. There is a need, therefore, to also provide the status of the main contacts.

Typically, there are significant space limitations in relatively small, miniature circuit breakers. Adding micro-switches to small circuit breakers has been found to be difficult because such breakers typically have limited space due to their configuration for mounting in a standardized load center or panelboard. U.S. Pat. No. 5,552,755 discloses an example of a small residential or light industrial or commercial circuit breaker, which is provided with a micro-switch to generate an electrical indication that the circuit breaker contacts are opened. Two cascaded actuating members, one actuated by the handle structure and one by the cradle, are incorporated into the circuit breaker for actuating a plunger of the micro-switch and indicating the operating status of the breaker.

U.S. Pat. No. 5,907,461 discloses a circuit breaker including a bell switch and an auxiliary switch positioned in the circuit breaker housing for actuation by levers mounted on a cradle pin and crossbar, respectively.

U.S. Pat. No. 6,040,746 discloses micro-switches mounted in a compartment and molded housing of a circuit breaker separate from the compartment in which the circuit breaker mechanism is mounted. The micro-switches are actuated to indicate the operating status of the circuit breaker by cascaded first and second actuating members. The first actuating member bears against a cam surface on the operating handle of the circuit breaker. The cam surface actuates the micro-switches through the first actuating member when the operating handle is in the OFF position. The second actuating member engages a cradle of the circuit breaker and actuates the micro-switches through the first actuating member when the cradle is unlatched (i.e., tripped).

U.S. Pat. No. 6,104,265 discloses a miniature circuit breaker including side-by-side ganged cases. One of the ganged cases includes the main circuit breaker operating mechanism and contacts and the other ganged case includes an actuable micro-switch having a switch bar. A handle tie arrangement interconnects one circuit breaker handle with a similar handle in the parallel cell of the circuit breaker arrangement. If the circuit breaker mechanism of the active cell is opened, a common tie-in member causes the handle and, thus, a peninsula portion of the handle to move toward the switch bar and cause it to actuate the switch and provide an external indication that the circuit breaker has opened. However, a different mechanism actuates the switch when the circuit breaker is tripped. A rotatable axial shaft extending from the adjacent chamber includes an electrically insulating triggering device having an elongated cam member, which rotates toward the switch bar and causes it to actuate the switch.

There is room for improvement in circuit breakers including a switch which follows the ON, tripped and OFF states of the operating mechanism.

SUMMARY OF THE INVENTION

This need and others are satisfied by the invention, which is directed to a circuit breaker, which includes a switch that provides the status of the circuit breaker's separable contacts (i.e., ON, tripped, OFF). A switching mechanism, such as a micro-switch, is provided internal to the circuit breaker housing and is actuated by the operator handle or movable contact arm of the operating mechanism. The contact of the switch, in turn, is wired in a variety of fashions. As one example, the switch contact is used in conjunction with a remote controlled circuit breaker in order to provide feedback of both the main separable contacts as well as the relay switching contacts.

As one aspect of the invention, a circuit breaker comprises: a housing; at least one set of separable contacts including a set of main contacts; an operating mechanism including an operator handle for opening and closing the separable contacts, the operator handle having a surface, an ON position, a tripped position, and an OFF position, the separable contacts being closed in the ON position, being open in the tripped position, and being open in the OFF position; a trip mechanism releasing the operating mechanism to move the operator handle to the tripped position; and a switch including an actuator lever movable between an actuated position and a non-actuated position and adapted to engage the surface of the operator handle of the operating mechanism, the switch also including a contact having a first state corresponding to the actuated position and a second state corresponding to the non-actuated position, the surface of the operator handle engaging and moving the actuator lever to the actuated position in only the ON position of the operator handle, the actuator lever being in the non-actuated position in the OFF position and the tripped position of the operator handle.

According to a preferred practice, the housing includes a base portion and a cover portion; and the switch is a micro-switch having a first side, which engages the base portion, and an opposite second side, which engages the cover portion.

As another preferred practice, the at least one set of separable contacts is the set of main contacts; and the contact of the switch has an input adapted to receive a voltage and an output adapted to provide a feedback voltage external to the housing when the set of separable contacts is closed.

As another aspect of the invention, a circuit breaker comprises: separable contacts; an operating mechanism including a movable contact arm for opening and closing the separable contacts, the movable contact arm having a surface, an ON position, a tripped position, and an OFF position, the separable contacts being closed in the ON position, being open in the tripped position, and being open in the OFF position; a trip mechanism releasing the operating mechanism to move the movable contact arm to the tripped position; and a switch including an actuator lever movable between an actuated position and a non-actuated position and adapted to engage the surface of the movable contact arm of the operating mechanism, the switch also including a contact having a first state corresponding to the actuated position and a second state corresponding to the non-actuated position, the surface of the movable contact arm engaging and moving the actuator lever to the actuated position in the tripped position and the OFF position of the movable contact arm, the actuator lever being in the non-actuated position in the ON position of the movable contact arm.

As a further aspect of the invention, a circuit breaker comprises: a molded housing having a base portion and a cover portion; separable contacts; an operating mechanism including an operator handle for opening and closing the separable contacts, the operator handle having a surface, an ON position, a tripped position, and an OFF position, the separable contacts being closed in the ON position, being open in the tripped position, and being open in the OFF position; a trip mechanism releasing the operating mechanism to move the operator handle to the tripped position; and a micro-switch including an actuator lever movable between an actuated position and a non-actuated position and adapted to engage the surface of the operator handle of the operating mechanism, the switch also including a contact having a first state corresponding to the actuated position and a second state corresponding to the non-actuated position, the surface of the operator handle engaging and moving the actuator lever to the actuated position in the ON position of the operator handle, the actuator lever being in the non-actuated position in the OFF position and the tripped position of the operator handle, the micro-switch having a first side, which engages the base portion of the molded housing, and an opposite second side, which engages the cover portion of the molded housing.

As one preferred practice, the base portion and the cover portion of the molded housing define a compartment, which houses the separable contacts, the operating mechanism, the trip mechanism and the micro-switch.

As another aspect of the invention, a circuit breaker comprises: separable contacts; an operating mechanism including an operator handle for opening and closing the separable contacts, the operator handle having a surface, an ON position, a tripped position, and an OFF position, the separable contacts being closed in the ON position, being open in the tripped position, and being open in the OFF position; a trip mechanism releasing the operating mechanism to move the operator handle to the tripped position; a micro-switch including a first side, an opposite second side, and an actuator lever movable between an actuated position and a non-actuated position and adapted to be actuated by the surface of the operator handle of the operating mechanism, the switch also including a contact having a first state corresponding to the actuated position and a second state corresponding to the non-actuated position, the contact having one of the first and second states in the ON position of the operator handle, and having the other of the first and second states in the OFF position and the tripped position of the operator handle; and a molded housing having a base portion, which engages the first side of the micro-switch, and a cover portion, which engages the second side of the micro-switch, the base portion and the cover portion of the molded housing defining a compartment, which houses the separable contacts, the operating mechanism, the trip mechanism and the micro-switch.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention will be described as applied to a miniature circuit breaker, although it will become apparent that it could be applied to other types of circuit breakers as well.

Figure 1:
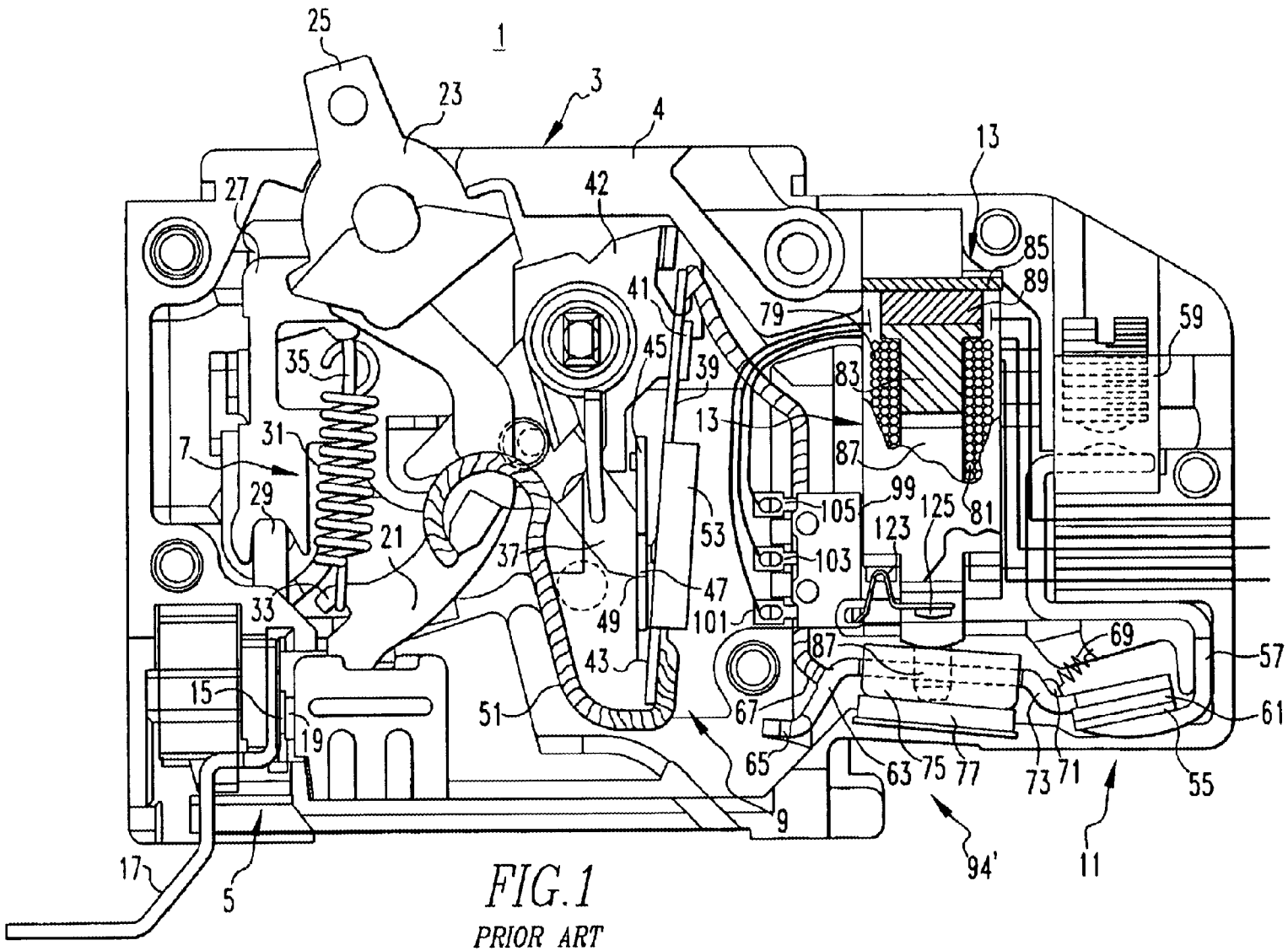
FIG. 1 PRIOR ART
FIG. 1 is an elevational view of a remotely controllable circuit breaker shown with the cover removed and with the main contacts and secondary contacts closed.
Figure 2:
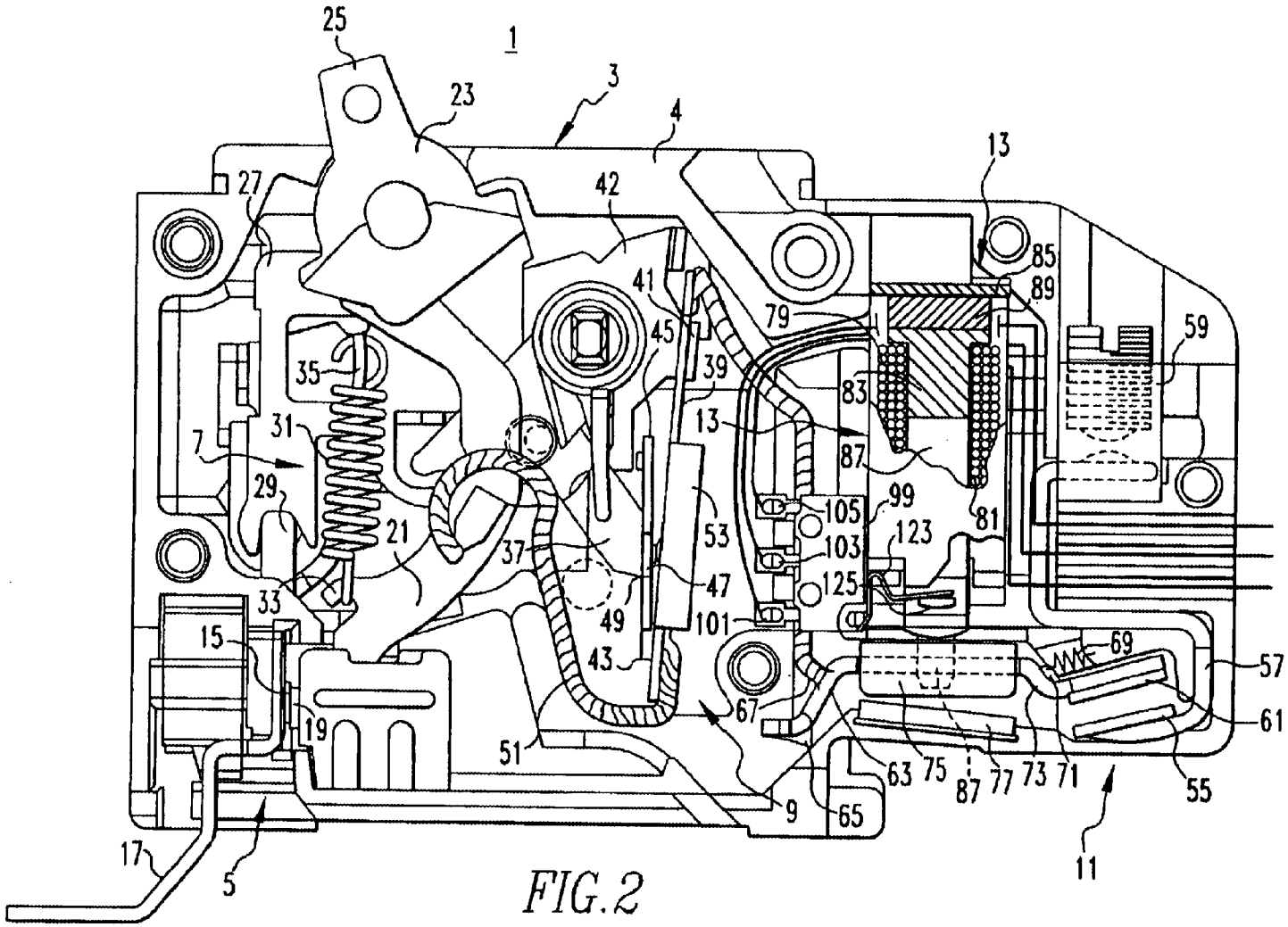
FIG. 2 PRIOR ART
FIG. 2 is a view similar to that of FIG. 1 with the secondary contacts open.

FIGS. 1 and 2 show a miniature circuit breaker 1 including a molded housing 3 having a base portion 4 with the cover portion (not shown) of the housing removed. The basic components of the circuit breaker 1 are a set of main contacts 5, an operating mechanism 7 for opening the set of main contacts 5, and a thermal-magnetic trip device 9 which actuates the operating mechanism to trip the set of main contacts 5 open in response to certain overcurrent conditions. Further included are a set of secondary contacts 11 and an actuator, such as a magnetically latchable solenoid 13, which is remotely controllable to control the open and closed states of the set of secondary contacts 11.

The set of main contacts 5 includes a fixed contact 15 secured to a line terminal 17 and a moveable main contact 19 which is affixed to an arcuate contact arm 21 which forms part of the operating mechanism 7. The operating mechanism 7 is a well-known device, which includes a pivotally mounted operator 23 with an integrally molded handle 25. The operating mechanism also includes a cradle 27 pivotally mounted on a support 29 molded in the housing. With the handle 25 in the ON position, as shown in FIGS. 1 and 2, a spring 31 connected to a hook 33 on the contact arm 21 and a tab 35 on the cradle 27 holds the main contacts 5 closed. The spring 31 also applies a force with the set of main contacts 5 closed, as shown, to the cradle 27 which tends to rotate the cradle in a clockwise direction about the support 29. However, the cradle 27 has a finger 37, which is engaged by the thermal-magnetic trip device 9 to prevent this clockwise rotation of the cradle under normal operating conditions.

The thermal-magnetic trip device 9 includes an elongated bimetal 39 which is fixed at its upper end to a tab 41 on the metal frame 42 seated in the molded housing 3. Attached to the lower, free end of the bimetal 39 by a lead spring 43 is an armature 45. The armature 45 has an opening 47, which is engaged by a latching surface 49 on the finger 37.

The free end of the bimetal 39 is connected to the contact arm 21 by a flexible braided conductor 51 so that the load current of the circuit protected by the circuit breaker 1 passes through the bimetal. A persistent overcurrent heats the bimetal 39, which causes the lower end to move to the right with respect to FIGS. 1 and 2. If this overcurrent is of sufficient magnitude and duration, the latching surface 49 on the finger 37 is pulled out of engagement with the armature 45. This allows the cradle 27 to be rotated clockwise by the spring 31. The clockwise rotation of the cradle 27 moves the upper pivot point for the contact arm 21 across the line of force of the spring 31 so that the contact arm is rotated counter-clockwise, to open (not shown) the set of main contacts 5, as is well understood. This also results in the handle 25 rotating to an intermediate position (not shown) to indicate the tripped condition of the set of main contacts 5.

In addition to the armature 45, a magnetic pole piece 53 is supported by the bimetal 39. Very high overcurrents, such as those associated with a short circuit, produce a magnetic field which draws the armature 45 to the pole piece 53, thereby also releasing the cradle 27 and tripping the set of main contacts 5 open. Following either trip, the main set of contacts 5 are reclosed by moving the handle 25 fully clockwise, which rotates the cradle 27 counter-clockwise until the finger 37 relatches in the opening 47 in the armature 45. Upon release of the handle 25, it moves counter-clockwise slightly from the full clockwise position and remains there. With the cradle relatched, the line of force of the spring 31 is reestablished to rotate the contact arm 21 clockwise to close the set of main contacts 5 when the handle 25 is rotated fully counter-clockwise to the position shown in FIGS. 1 and 2.

The set of secondary contacts 11 includes a fixed secondary contact 55 which is secured on a load conductor 57 which leads to a load terminal 59. The set of secondary contacts 11 also includes a moveable secondary contact 61 which is fixed to a secondary contact arm 63 which at its opposite end is seated in a molded pocket 65 in the molded housing 3. The secondary contact arm 63 is electrically connected in series with the set of main contacts 5 by a second flexible braided conductor 67 connected to the fixed end of the bimetal 39. Thus, a circuit or load current is established from the line terminal 17 through the set of main contacts 5, the contact arm 21, the flexible braided conductor 51, the bimetal 39, the second flexible braided conductor 67, the secondary contact arm 63, the set of secondary contacts 11, and the load conductor 57 to the load terminal 59.

The set of secondary contacts 11 is biased to the closed state shown in FIG. 1 by a helical compression spring 69 seated on a projection 71 on an offset 73 in the secondary contact arm 63. As discussed in U.S. Pat. No. 5,301,083, the spring 69 is oriented such that the force that it applies to the secondary contact arm 63 tending to close the set of secondary contacts 11 is relaxed to a degree with the secondary contacts in the open position. This serves the dual purpose of providing the force needed to close the secondary contacts against rated current in the protected circuit and also reducing the force that must be generated by the magnetically latching solenoid 13 to hold the secondary contacts in the open state. In order for the set of secondary contacts 11 to withstand short circuit currents and allow the set of main contacts 5 to perform the interruption, the magnet force generated by the short circuit current causes an armature 75 mounted on the secondary contact arm 63 to be attracted to a pole piece 77 seated in the molded housing 3 thereby clamping the secondary contacts closed.

As shown by the partial sections in FIGS. 1 and 2, the actuator/solenoid 13 includes a first or close coil 79 and a second or open coil 81 concentrically wound on a steel core 83 supported by a steel frame 85. A plunger 87 moves rectilinearly within the coils 79 and 81. A permanent magnet 89 is seated between the steel core 83 and the steel frame 85.

The plunger 87 engages the secondary contact arm 63. When the close coil 79 is energized, a magnetic field is produced which drives the plunger downward to a first position which rotates the secondary contact arm 63 clockwise and thereby moves the set of secondary contacts 11 to the closed state. The secondary contacts 11 are maintained in the closed state by the spring 69. When it is desired to open the set of secondary contacts 11, the open coil 81 is energized which lifts the plunger 87 and with it the secondary contact arm 63 to a second position which opens the set of secondary contacts 11. With the plunger 87 in the full upward position as shown in FIG. 2, it contacts the steel core 83 and is retained in this second position by the permanent magnet 89. Subsequently, when the close coil 79 is energized, the magnetic field generated is stronger than the field generated by the permanent magnet and therefore overrides the latter and moves the plunger 87 back to the first, or closed position.

Figure 3:
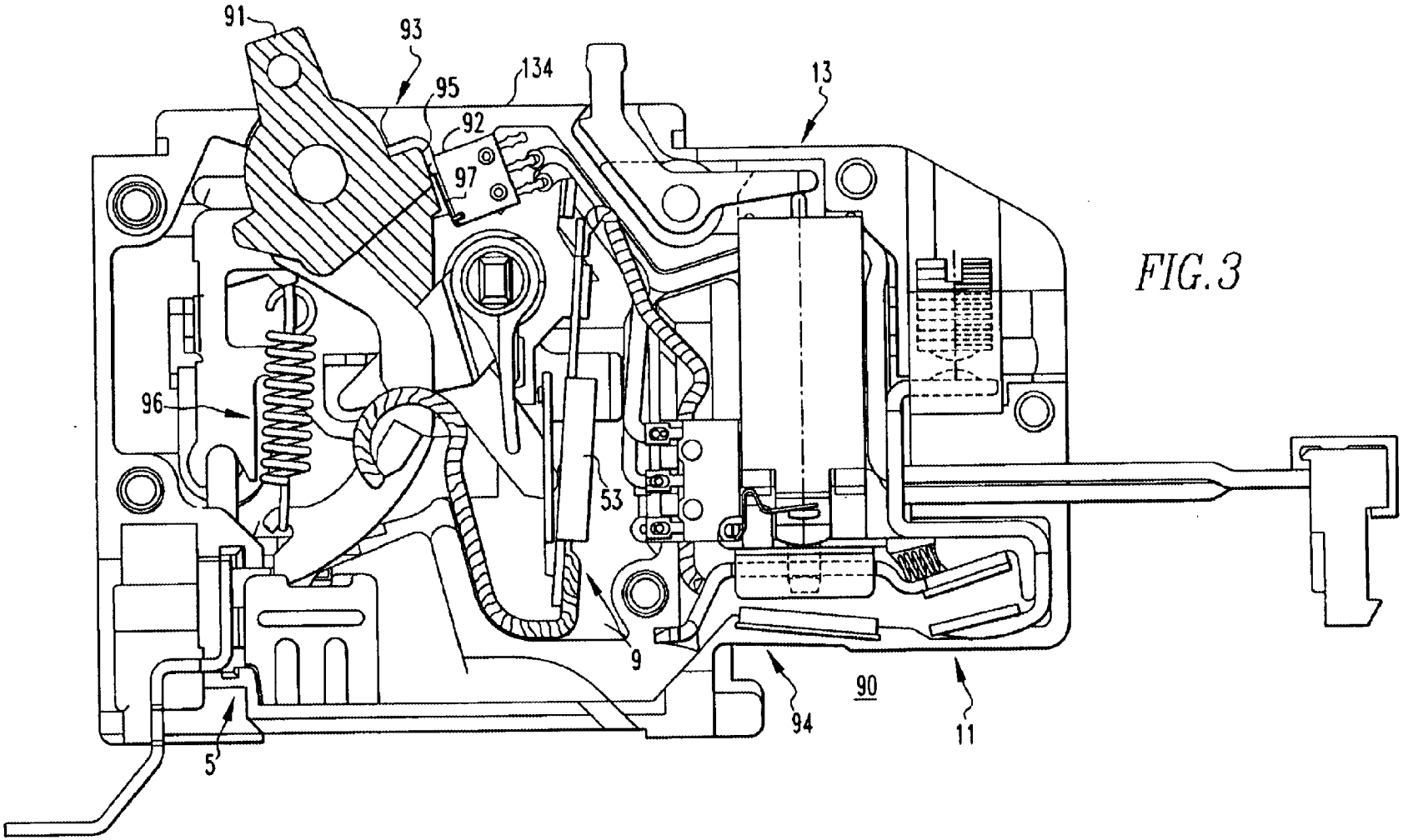
FIG. 3 is an elevational view of a remotely controllable circuit breaker in accordance with an embodiment of the invention in which the operator handle actuates the actuator lever of a micro-switch in the handle ON position.
Figure 4:
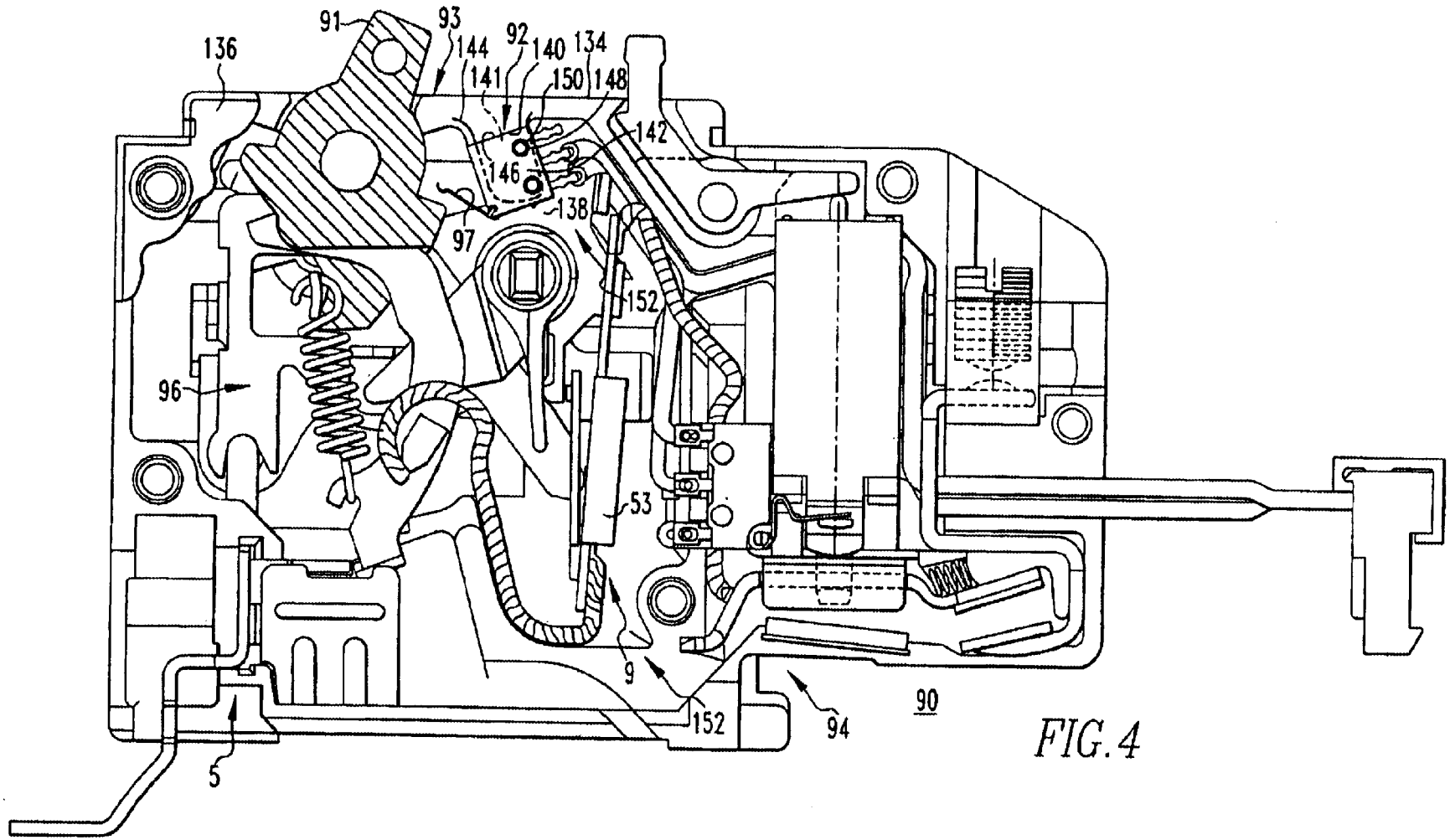
FIG. 4 is a view similar to that of FIG. 3 with the operator handle disengaged from the actuator lever of the micro-switch in the handle OFF position.
Figure 5:
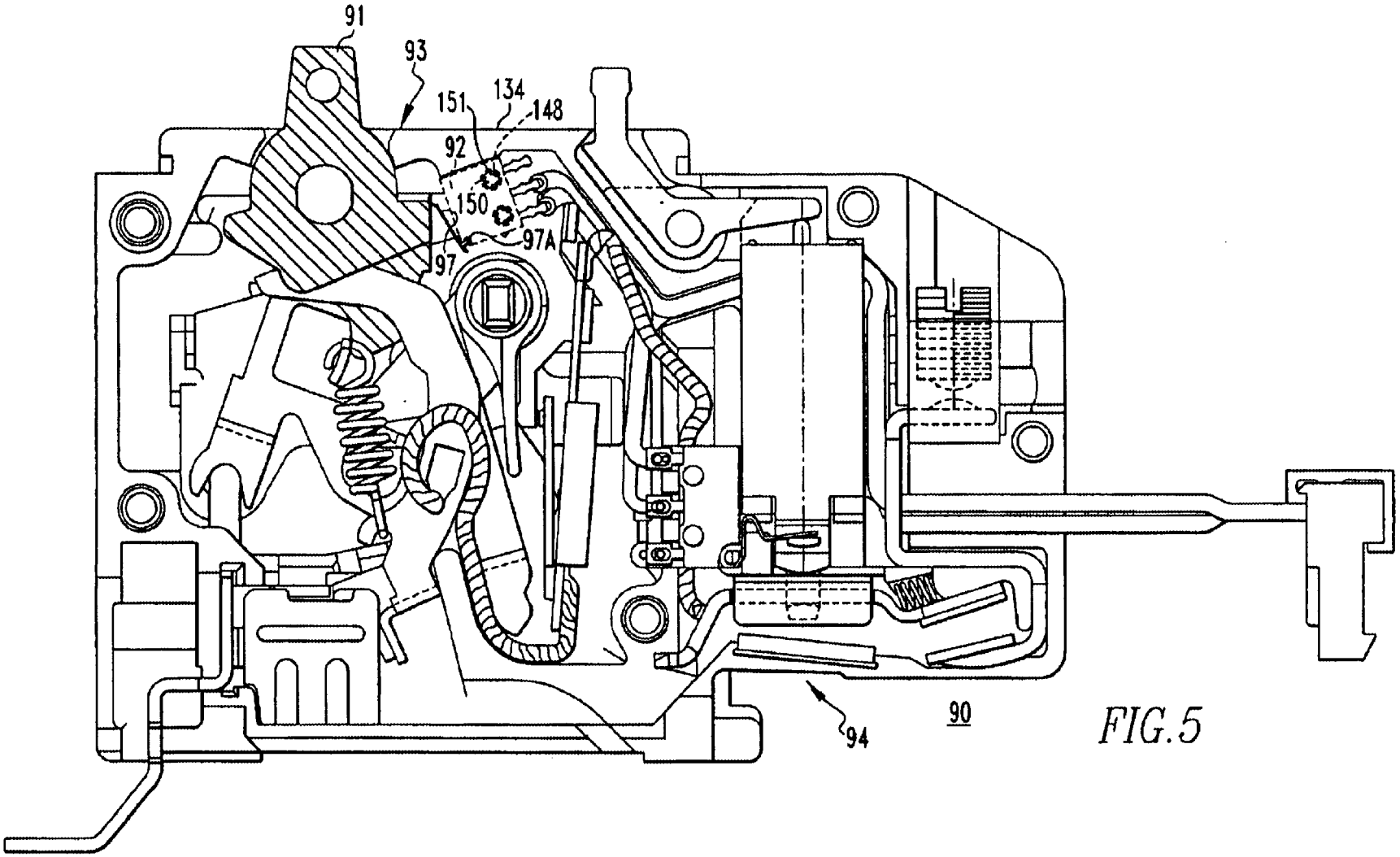
FIG. 5 is a view similar to that of FIG. 3 with the operator handle in the handle tripped position and not actuating the actuator lever of the micro-switch.
Figure 6:
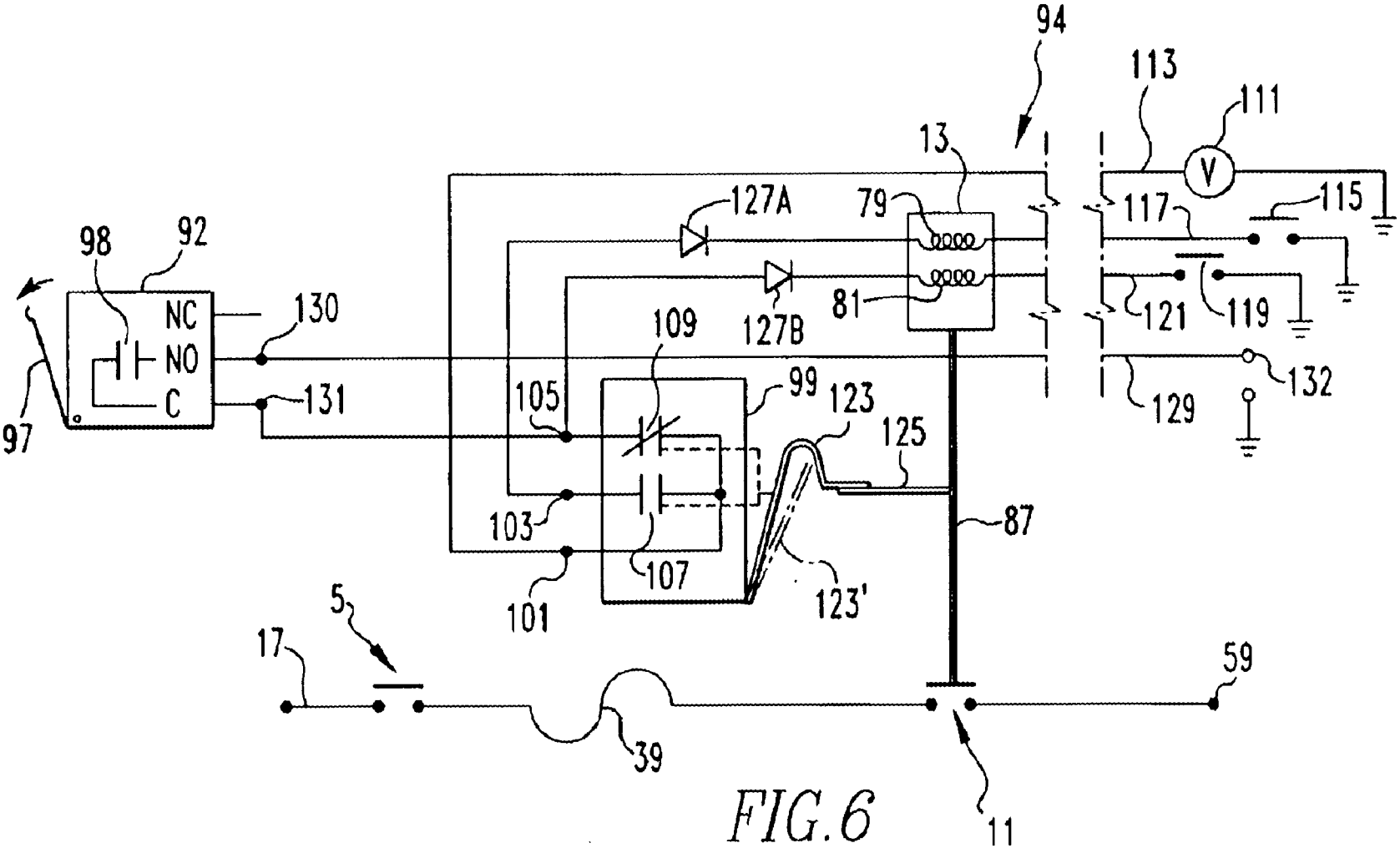
FIG. 6 is a schematic circuit diagram of a control and monitoring circuit for the remotely controllable circuit breaker of FIG. 3.

FIGS. 3–5 show a remotely controllable circuit breaker 90 in accordance with the present invention. The circuit breaker 90 is similar to the circuit breaker 1 of FIGS. 1 and 2, expect that it includes the pivotally mounted operator handle 91 (FIGS. 3–5), a switch such as the exemplary micro-switch 92 (FIGS. 3–6), molded housing 93 (FIGS. 3–5), and control and monitoring circuit 94 (as best shown in FIG. 6). The operator handle 91 has a surface 95, an ON position (shown in FIG. 3), an OFF position (FIG. 4), and a tripped position (FIG. 5). As is well known, the main separable contacts 5 are closed in the ON position of FIG. 3, and are open in the OFF and tripped positions, and the operator handle 91 is employed to open and close the separable contacts 5. As discussed in connection with FIGS. 1–2, the thermal-magnetic trip device 9 and/or the magnetic pole piece 53 release the operating mechanism 96 of FIG. 3 and the operator handle 91 to the tripped position as shown in FIG. 5.

The micro-switch 92 includes an actuator lever 97 movable between an actuated position (FIG. 3) and a non-actuated position (FIGS. 4 and 5). The actuator lever 97 is adapted to engage the surface 95 of the operator handle 91 as shown in FIG. 3. The micro-switch 92 includes a normally open contact 98 (FIG. 6), which is closed in the actuated position of the micro-switch and is otherwise open in the non-actuated position. The surface 95 of the operator handle 91 engages and moves the actuator lever 97 to the actuated position in only the ON position (FIG. 3) of the operator handle. Otherwise, the actuator lever 97 is in the non-actuated position in the OFF position (FIG. 4) and the tripped position (FIG. 5) of the operator handle 91. The exemplary micro-switch 92 also includes a normally closed contact (not shown), although the invention is applicable to any suitable switch having a single normally open or closed contact.

As shown in FIG. 5, in the handle tripped position, the actuator lever 97 has pivoted counter-clockwise about pivot point 97A to at or past its non-actuated position. In the exemplary embodiment, the operator handle 91 continues to engage the actuator lever 97, which remains in the non-actuated position, in the tripped position of the operator handle. As shown in FIG. 4, the operator handle 91 is disengaged from the actuator lever 97 in the handle OFF position. The invention, however, is not limited by the exemplary embodiment and is applicable to any operator handle in which an operator handle surface engages and moves a switch actuator lever to its actuated position in only the ON position of such operator handle, with such actuator lever being in its non-actuated position in the OFF position and the tripped position of the operator handle.

FIG. 6 shows a schematic circuit diagram of the control and monitoring circuit 94 for the circuit breaker 90 of FIGS. 3–5. The circuit 94 is similar to a circuit 94' employed by the circuit breaker 1 of FIG. 1, except that the normally open contact 98 of the micro-switch 92 is employed in the feedback monitoring function as discussed below. The first and second or close and open coils 79,81 of the magnetically latching solenoid 13 are remotely controlled by the circuit 94. This circuit 94 includes a switch or internal power cutoff device in the form of micro-switch 99, which has a common terminal 101 and first and second switched terminals 103, 105. The micro-switch 99 includes a first contact 107 connected between the common terminal 101 and the first switched terminal 103, and a second contact 109 connected between the common terminal 101 and the second switched terminal 105. In the form of the circuit shown, the first contact 107 of the micro-switch 99 is a normally open contact and the second contact 109 is a normally closed contact. The common terminal 101 of the micro-switch 99 is connected to a remotely located voltage source 111 through a lead 113. The first or close coil 79 of the solenoid 13 is connected between the first switched terminal 103 of the micro-switch 99 and a remotely located second or close switch 115 through diode 127A and through a lead 117. The other side of the close switch 115 is connected to ground. Similarly, the second or open coil 81 is connected between the second switched terminal 105 of the micro-switch 99 and a third or open switch 119 through diode 127B and through lead 121. Again, the other side of the switch 119 is grounded.

The micro-switch 99 has an operating member in the form of actuator lever 123, which is engaged by a projection 125 on the plunger 87 of the solenoid 13. When the solenoid 13 is latched is in the upward or second position (as shown in FIG. 6) so that the second set of contacts 11 is open, the micro-switch 99 is actuated and the first or normally open contact 107 is closed while the normally closed contact 109 is open. Thus, the voltage source 111 is connected to enable the close coil 79 so that whenever the remote close switch 115 is closed, the coil 79 will be energized. A rectifier circuit is implemented by exemplary diodes 127A, 127B from terminals 103,105, respectively. In this manner, only voltage of the proper polarity can energize the coil 79 to effect downward movement of the plunger 87. Also, with the diodes 127A,127B, an AC voltage as well as a DC voltage can be used for the voltage source 111. The diodes 127A, 127B will provide half wave rectification of any AC signal. Since the solenoid 13 latches in the open and closed positions, only momentary power is needed to open and close the set of secondary contacts 11. This momentary power can be provided by an AC source, a DC source or a pulse source. Alternatively, in place of the diodes 127A, 127B, a suitably polarized diode (not shown) having its cathode electrically connected to the terminal 101 can be provided in the lead 113.

When the close coil 79 is energized, the plunger 87 is driven downward to its first position which closes the set of secondary contacts 11 and allows the actuator lever 123 of the micro-switch 99 to move to the closed position 123' shown in phantom in FIG. 6. This results in closure of the normally closed contact 109 and opening of the normally open contact 107. The set of secondary contacts 11 remains latched in the closed position due to the spring 69. With the normally closed contact 109 now closed, the open coil 81 is enabled by application of the voltage from the voltage source 111. However, no current flows through the open coil 81 until the remote open switch 119 is closed to complete the circuit for the open coil.

In accordance with the present invention, the normally closed contact 109, which is closed when the secondary contacts 11 are closed, is electrically connected in series with the normally open contact 98 of the first micro-switch 92. That normally open contact 98 is closed when the actuator lever 97 is actuated and the set of main contacts 5 is closed. In order to provide an indication of the status of both the main contacts 5 and the secondary contacts 11, a status line 129 is electrically connected to one terminal 130 (NO) of the micro-switch 92 and the other terminal 131 (C) is electrically connected to the second switched terminal 105 of the micro-switch 99. With both sets of the contacts 5,11 being closed, the normally open contact 92 and the normally closed contact 109 are closed. The status line 129 therefore provides a voltage signal from voltage source 111 relative to ground at status terminals 132, which is indicative of the closed state of both sets of the contacts 5,11. That voltage signal is not present at the terminals 132 in the event that either or both of the contacts 5,11 are open, including the case when the contacts 5 are tripped open.

As the set of secondary contacts 11 is latched in either the open state or the closed state, it is not necessary to provide continuous power from the voltage source 111 to maintain them in either state. Accordingly, momentary signals can be used to control operation of the solenoid 13. The remote close and open switches 115 and 119 can be manual switches or automatic switches, such as output contacts of a computer system. Similarly, the status terminals 132 can be input terminals on such a computer-controlled system.

Although a voltage signal is provided relative to ground at status terminals 132 when both sets of the contacts 5,11 are closed, the feedback logic may be reversed by employing the normally open contact 107 of the micro-switch 99 in series with the normally closed (NC) contact of the micro-switch 92, such that a voltage signal is provided relative to ground at status terminals 132 when both sets of the contacts 5,11 are open.

Referring again to FIG. 4, the molded housing 93 includes a base portion 134 and a cover portion 136 (shown cut-away for convenience of reference). The base portion 134 includes a first surface 138, which engages a lower side 141 (shown in hidden line drawing) of the micro-switch 92, and a second surface 140, which is normal to the first surface 138. The upper side 142 of the micro-switch 92 engages a surface 144 (shown in phantom line drawing) of the cover portion 136. A side 146 of the micro-switch 92, which is normal to its lower and upper sides 141,142, engages the surface 140 of the base portion 134. The micro-switch 92 has an opening 148 extending from the lower side 141 to the upper side 142 thereof. A pin 150 (shown in phantom line drawing in FIG. 5) engages the micro-switch 92 (a portion of which is shown in phantom line drawing in FIG. 5) within the opening 148 and engages the base portion 134 within an opening 151 (FIG. 5) thereof. In this manner, the micro-switch 92 is suitably and compactly secured within the housing 93 by the surfaces 138,140,144 and the pin 150. Alternatively, two pins (not shown) may be employed, or one or two protrusions (not shown) may be provided from the base portion 134.

In accordance with a preferred practice of the invention, the base and cover portions 134,136 of the molded housing 93 define a single compartment 152, which houses the separable contacts 5, the operating mechanism 96, the trip mechanism formed by the exemplary thermal-magnetic trip device 9 and the magnetic pole piece 53, and the micro-switch 92.

Figure 7:
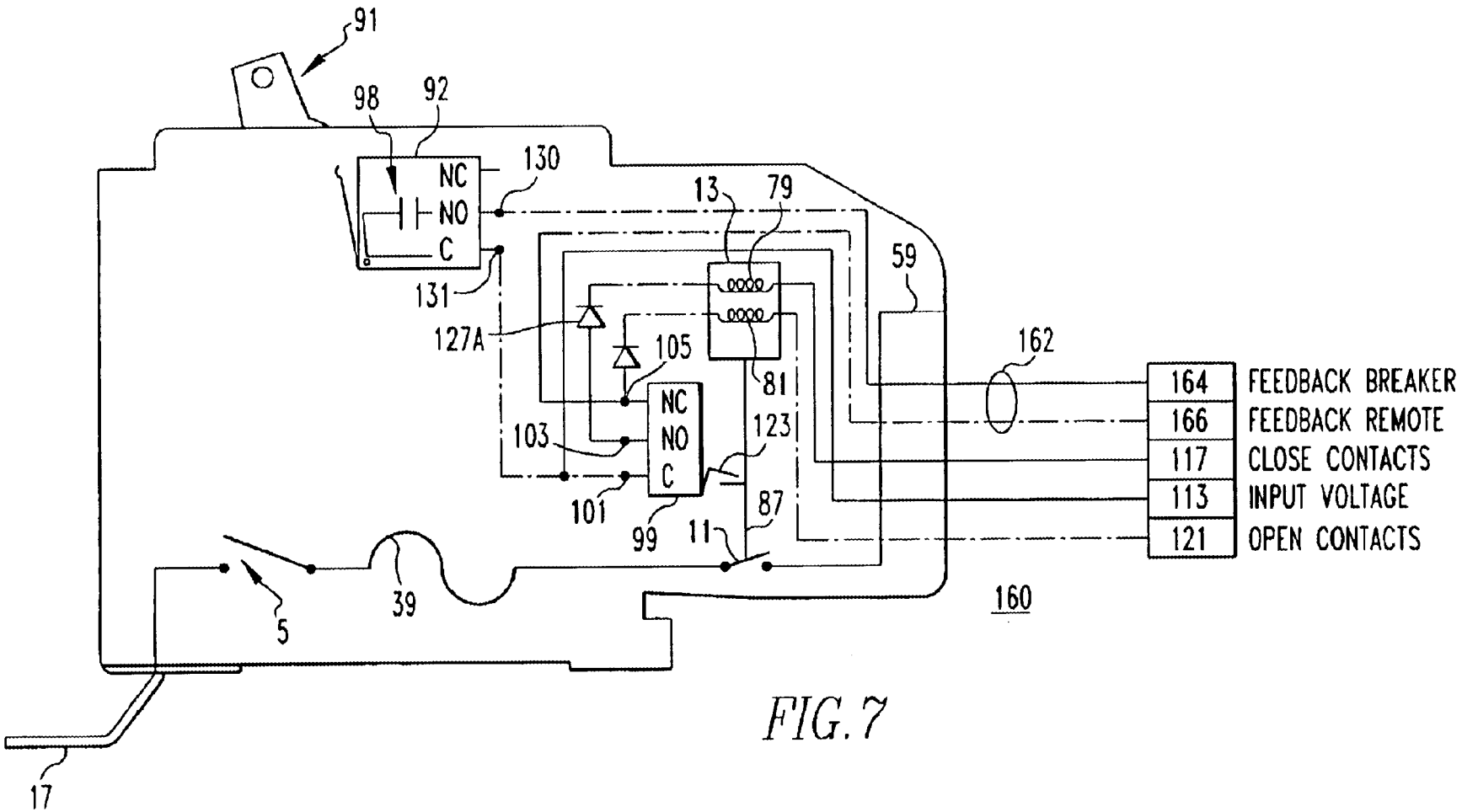
FIG. 7 is a schematic circuit diagram of another control and monitoring circuit for a remotely controllable circuit breaker in accordance with another embodiment of the invention.

FIG. 7 shows a remotely controllable circuit breaker 160, which is similar to the circuit breaker 90 of FIGS. 3–5, except that a different feedback circuit 162 is employed. The circuit 162 includes a first lead 164, which is electrically connected to the (NO) terminal 130 of the micro-switch 92, and a second lead 166, which is electrically connected to the (NO) terminal 105 of the micro-switch 99. Also, the lead 113 providing the input voltage from a voltage source (not shown) is electrically connected to the common terminals 101,131 of both of the respective micro-switches 99,92. The normally open (NO) contact 98 of the micro-switch 92, thus, provides a feedback voltage on lead 164 when the main contacts 5 are closed. The feedback voltage is, however, not present whenever those contacts are open or tripped open. In a similar manner, the normally closed (NC) contact of the micro-switch 99 provides a feedback voltage on lead 166 when the secondary contacts 11 are closed. That feedback voltage is, however, not present whenever those contacts are open.

Figure 8:
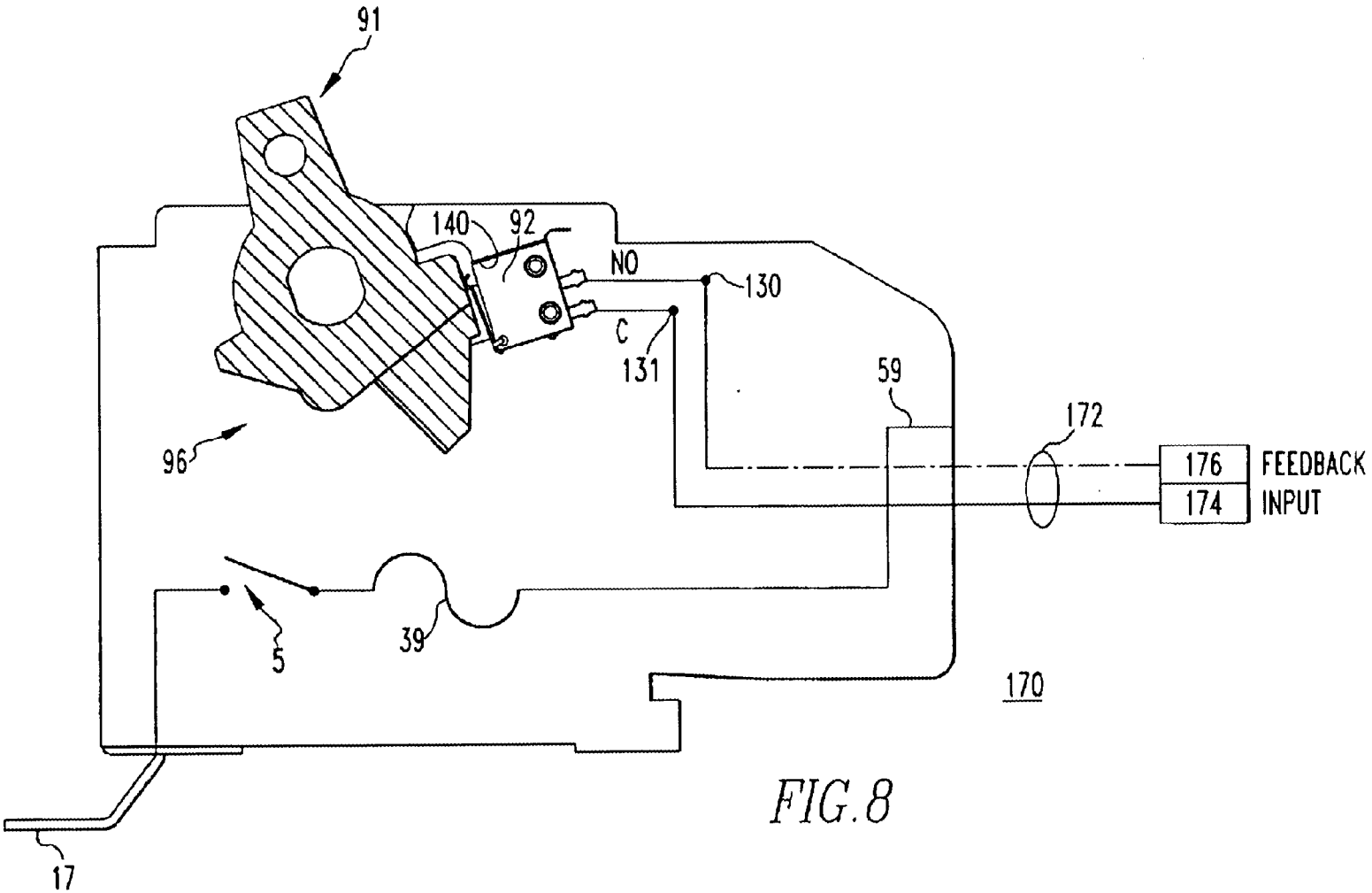
FIG. 8 is a schematic circuit diagram of a monitoring circuit for a circuit breaker in accordance with another embodiment of the invention.

FIG. 8 shows a circuit breaker 170, which is a simplified form of the circuit breaker 90 of FIGS. 3–5, in that the secondary contacts 11 and the control and monitoring circuit 94 are removed, and the main contacts 5 and elongated bimetal 39 are electrically connected in series between the line terminal 17 and the load terminal 59. Otherwise, the circuit breaker 170 includes the operating mechanism 96, the operator handle 91, and the micro-switch 92 of FIGS. 3–5 in combination with a different feedback circuit 172. The normally open contact of the micro-switch 92 has the terminal 131 adapted to receive a voltage from lead 174 and also has the terminal 130 adapted to provide a feedback voltage on lead 176 when the separable contacts 5 are closed. Alternatively, the feedback logic may be reversed by employing a normally closed (NC) contact (not shown), such that a voltage signal is provided on lead 176 when the separable contacts 5 are open.

Figure 9:
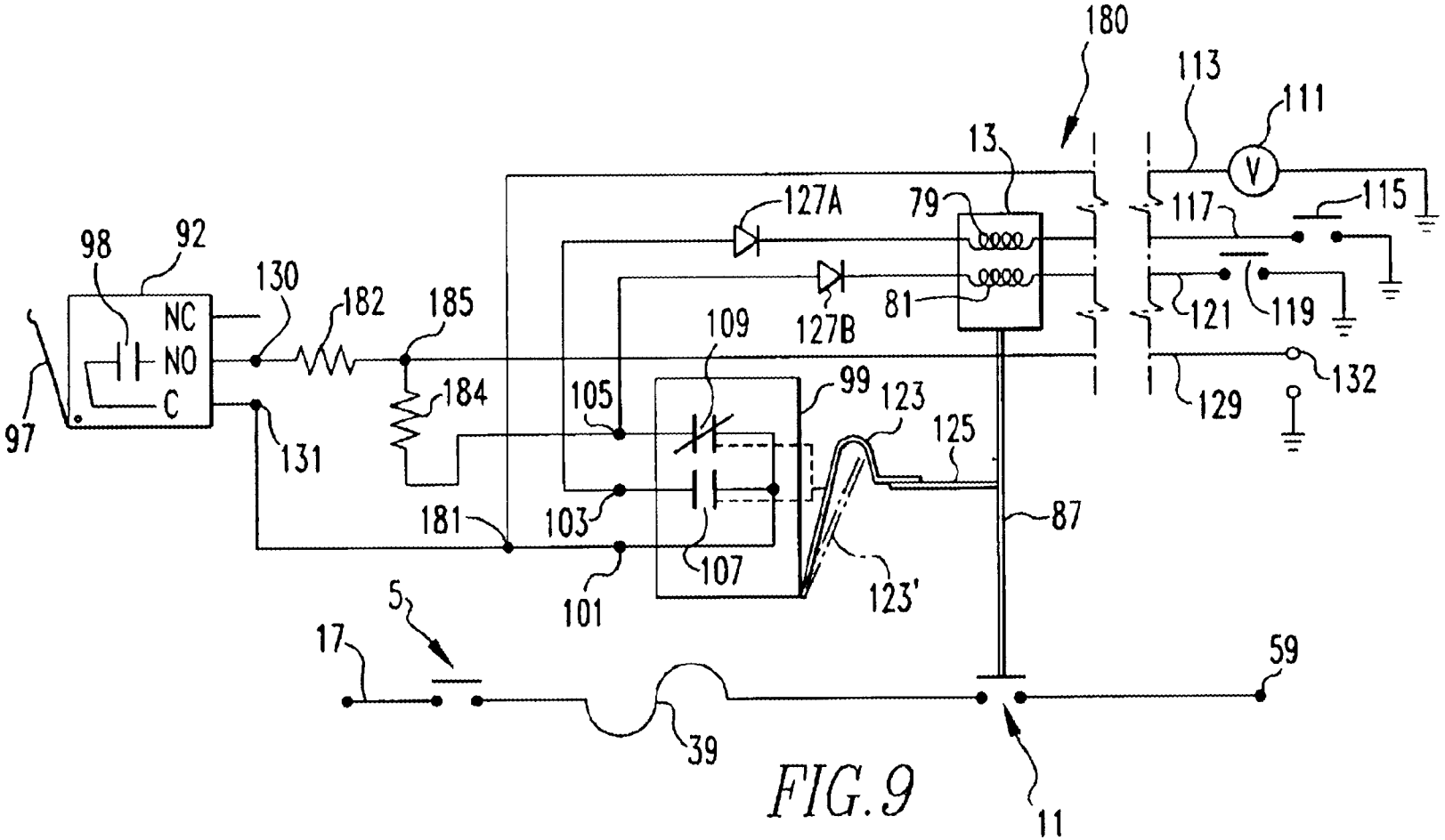
FIG. 9 is a schematic circuit diagram of another control and monitoring circuit for the remotely controllable circuit breaker of FIG. 3.

FIG. 9 shows another control and monitoring circuit 180 for the remotely controllable circuit breaker 90 of FIGS. 3–5. The circuit 180 is different from the circuit 94 of FIG. 6 in that a different monitoring function is provided. In this embodiment, the normally closed contact 109 of the micro-switch 99, which contact is closed when the secondary contacts 11 are closed, is electrically connected in series with the normally open contact 98 of the micro-switch 92, which contact is closed when the main contacts 5 are closed. The lead 113 from the voltage source 111 is electrically connected to a node 181 defined by the common terminals 101,131 of the two micro-switches 99,92. A first circuit element, which in the exemplary embodiment is a first resistor 182, is electrically connected between the normally open contact 98 and node 185 at the status line 129, and a second circuit element, which in the exemplary embodiment is a second resistor 184, is electrically connected between the normally closed contact 109 of the micro-switch 99 and the node 185. According to one practice, the resistor 182 has a first resistance value (e.g., 2 KΩ) and the resistor 184 has a different second resistance value (e.g., 4 KΩ). In this manner, four unique status signals may be provided at the status terminals 132 based upon the four possible states of the separable contacts 5,11 (e.g., OFF/OFF, OFF/ON, ON/OFF, and ON/ON). Alternatively, the resistors 182,184 may be replaced by diodes (not shown) having their cathodes or anodes electrically connected to the node 185, whenever the voltage source 111 is an AC source.

Figure 10:
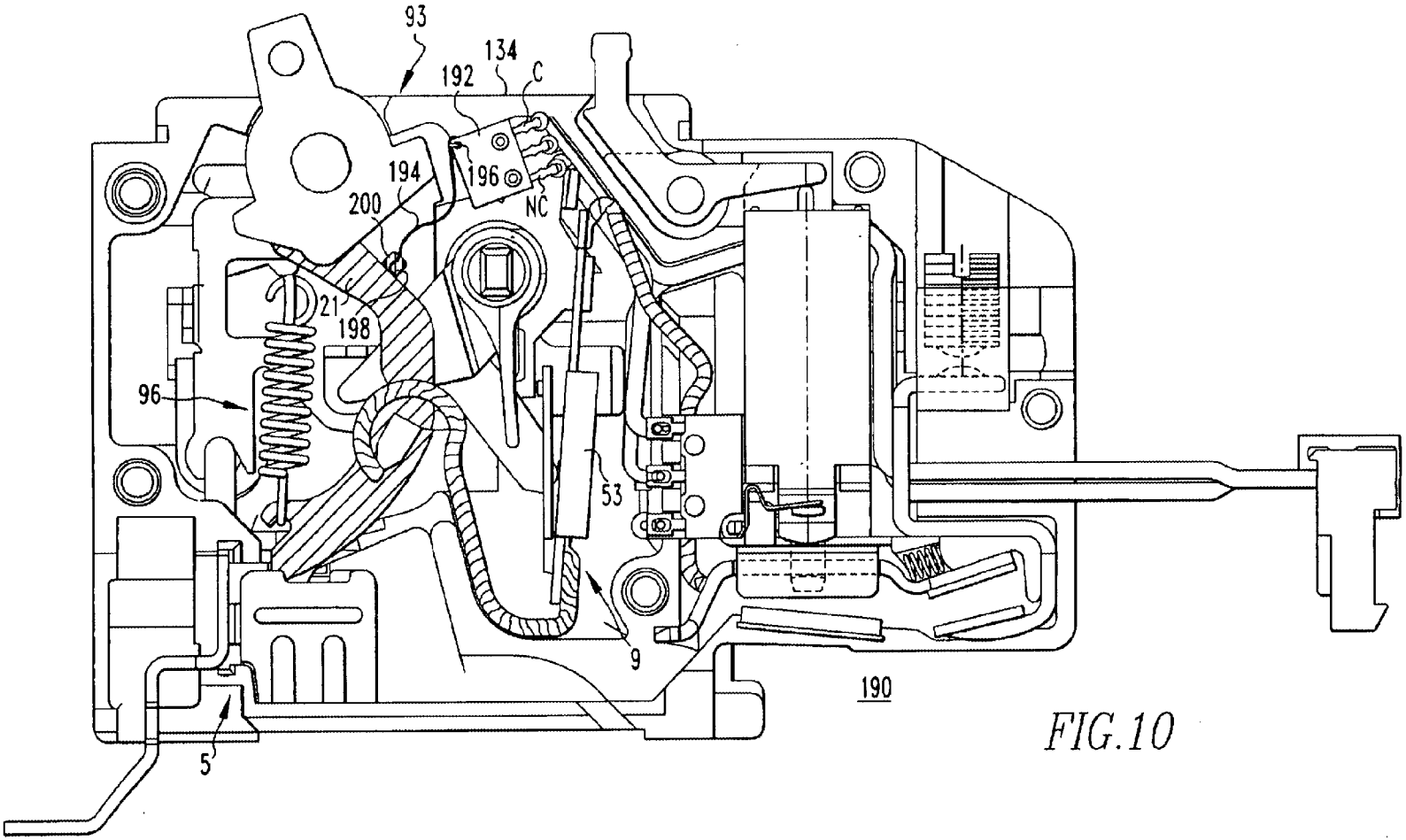
FIG. 10 is an elevational view of a remotely controllable circuit breaker in accordance with another embodiment of the invention in which the movable contact arm does not actuate the actuator lever of a micro-switch in the ON position.
Figure 11:
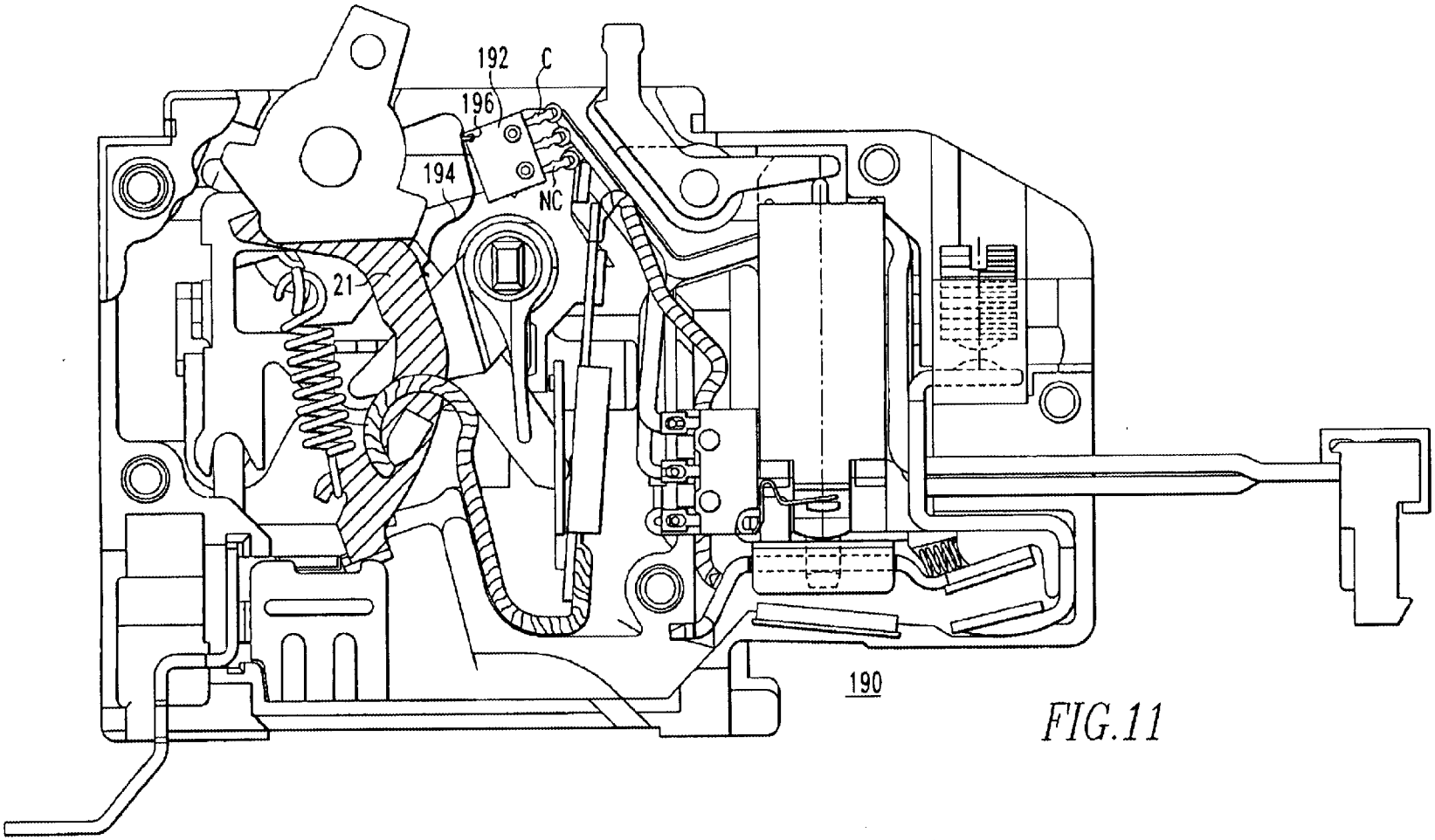
FIG. 11 is a view similar to that of FIG. 10 with the movable contact arm actuating the actuator lever of the micro-switch in the OFF position.
Figure 12:
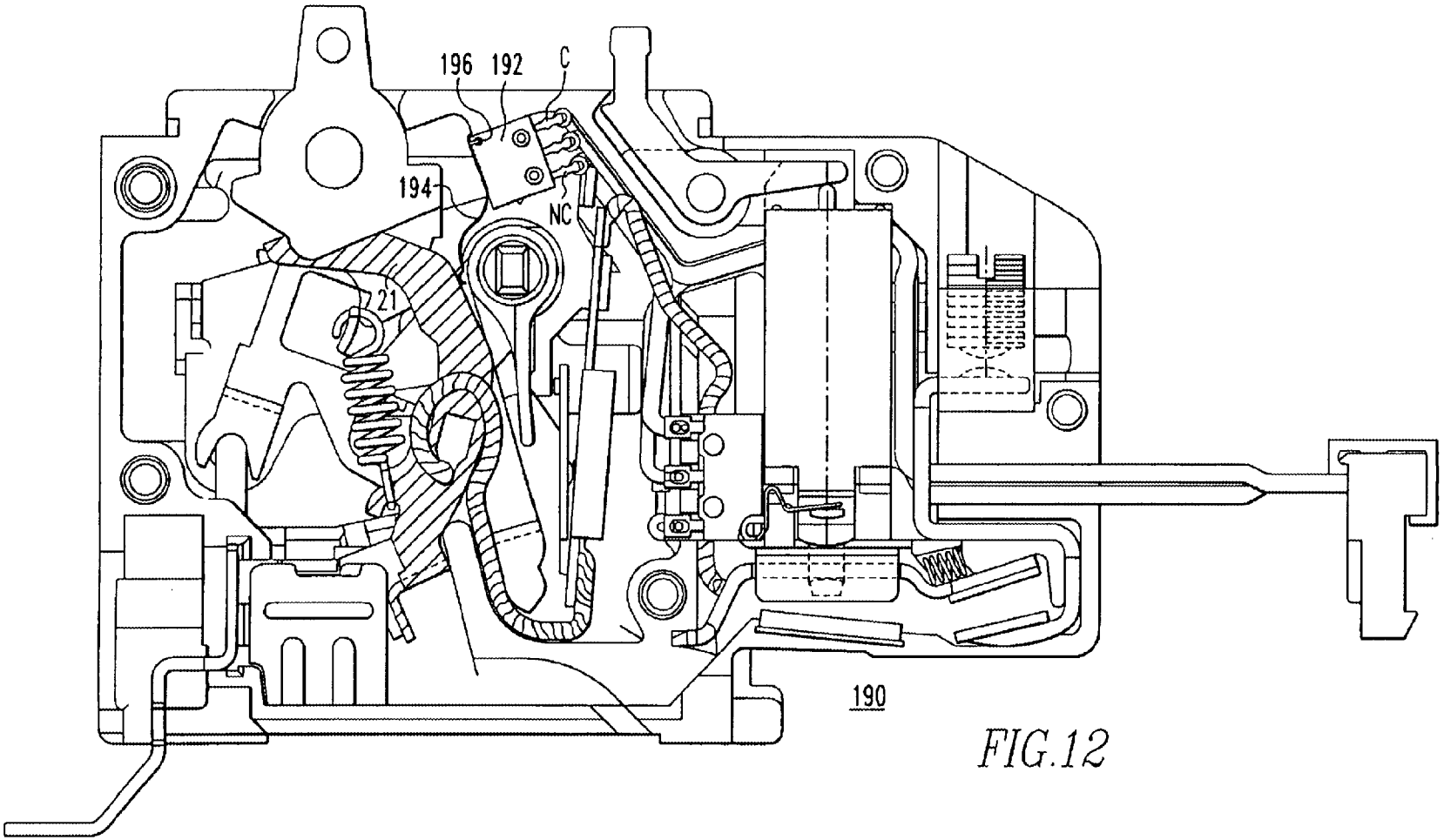
FIG. 12 is a view similar to that of FIG. 10 with the movable contact arm actuating the actuator lever of the micro-switch in the tripped position.

FIGS. 10–12 show a remotely controllable circuit breaker 190, which is similar to the circuit breaker 90 of FIGS. 3–5, except that a micro-switch 192 has a different actuator lever 194 and is mounted in an inverted position with respect to the base portion 134 of the molded housing 93. FIGS. 10, 11 and 12 respectively show the circuit breaker movable contact arm 21 of the operating mechanism 96 in the ON position, the OFF position and the tripped position. The actuator lever 194 is movable between an actuated position (FIGS. 11 and 12) and a non-actuated position (FIG. 10) and is adapted to engage the movable contact arm 21.

As shown in FIG. 10 the movable contact arm 21 engages, but does not actuate, the actuator lever 194 in the ON position. A surface 198 of the movable contact arm 21 engages and moves the actuator lever 194 to the actuated position in the tripped position (FIG. 12) and the OFF position (FIG. 11) of the arm 21. Otherwise, the actuator lever 194 is in the non-actuated position in the ON position of the arm 21. The normally closed (NC) contact of the micro-switch 192 has an open state corresponding to the actuated position (tripped and OFF positions) and a closed state corresponding to the non-actuated position (ON position). Hence, it will be appreciated that the normally closed (NC) contact of the micro-switch 192 may provide a similar functionality as the normally open (NO) contact 98 of the micro-switch 92 of FIGS. 3–9.

Preferably, since the movable contact arm 21 is energized in the ON position of the circuit breaker 190, the actuator lever 194 includes an insulator 200 such that the energized surface 198 of the arm 21 engages the insulator 200, but does not energize the actuator lever 194.

As shown in FIG. 11, in the handle OFF position, the actuator lever 194 has pivoted about pivot point 196 counter-clockwise at least to its actuated position. As shown in FIG. 12, some additional counter-clockwise rotation of the actuator lever 194 is possible in the tripped position of the movable contact arm 21. Although the surface 198 of the arm 21 engages the insulator 200 in the ON position of FIG. 10, the invention, however, is not limited by the exemplary embodiment and is applicable to any movable contact arm which engages and moves an actuator lever to an actuated position in the tripped position and the OFF position of such arm, with such actuator lever being in a non-actuated position in the ON position of such arm.

The exemplary switching mechanisms 92,192 actuate off of the operator handle 91 (FIGS. 3–5) or movable contact arm 21 (FIGS. 10–12). In the former embodiment, the switching mechanism is a micro-switch 92 having a normally open contact 98, which contact closes when the operator handle 91 is moved to the ON position to actuate the switch. In the latter embodiment, the switching mechanism is a micro-switch 192 having a normally closed contact, which contact opens when the movable contact arm 21 is moved to the OFF or tripped positions to actuate the switch. This change of state results in a dry contact closing and/or opening. In these examples, the micro-switches operate as a single pole, double throw switch. The closing and/or opening thereof may then be advantageously employed by a user as a feedback of the circuit breaker's position, thereby telling the user of the circuit breaker's status.

These exemplary switching mechanisms are advantageous in conventional thermal magnetic circuit breakers having one set of separable contacts, as well as in remote controlled circuit breakers having an additional set of relay switching contacts in series with the main contacts. In this manner, the user is able to distinguish between a remote operation that opens or closes the relay switching contacts from the opening or closing of the main contacts.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A circuit breaker comprising:

a housing;

at least one set of separable contacts including a set of main contacts;

an operating mechanism including an operator handle for opening and closing said set of main contacts, said operator handle having a surface, an ON position, a tripped position, and an OFF position, said main contacts being closed in said ON position, being open in said tripped position, and being open in said OFF position;

a trip mechanism releasing said operating mechanism to move said operator handle to said tripped position; and a switch including an actuator lever movable between an actuated position and a non-actuated position and adapted to engage the surface of the operator handle of said operating mechanism, said switch also including a contact having a first state corresponding to said actuated position and a second state corresponding to said non-actuated position, the surface of said operator handle engaging and moving said actuator lever to said actuated position in only the ON position of said operator handle, said actuator lever being in said non-actuated position in the OFF position and the tripped position of said operator handle;

wherein said at least one set of separable contacts includes said set of main contacts and a set of secondary contacts electrically connected in series with said set of main contacts, wherein said operating mechanism includes a solenoid moving said set of secondary contacts between closed and open positions, and a control circuit selectively energizing said solenoid, wherein said switch is a first switch, wherein said control circuit includes a second switch having a first contact controlling said solenoid, and a second contact electrically connected in series with said contact of said first switch, wherein the contact of said first switch is a normally open contact, with the first state of said normally open contact being closed when said first switch is actuated and said set of main contacts is closed, wherein the second contact of said second switch is closed when said solenoid moves said set of secondary contacts to the closed position thereof, wherein said control circuit is adapted to receive a voltage and apply the same to the second contact of said second switch, and wherein the contact of said first switch is adapted to output said voltage when said set of main contacts and said set of secondary contacts are both closed.

2. The circuit breaker of claim 1 wherein said housing includes a base portion and a cover portion; and wherein said switch is a micro-switch having a first side, which engages said base portion, and an opposite second side, which engages said cover portion.

3. The circuit breaker of claim 2 wherein said base portion includes a first surface, which engages the first side of said micro-switch, and a second surface, which is normal to said first surface; and wherein said micro-switch further has a third side, which is normal to said first and second sides, the third side of said micro-switch engaging the second surface of said base portion.

4. The circuit breaker of claim 3 wherein said base portion has an opening; and wherein said micro-switch has an opening extending from the first side to the second side thereof, said micro-switch also having a pin which engages said micro-switch within the opening thereof and engages said base portion within the opening thereof.

5. The circuit breaker of claim 1 wherein said operator handle engages said actuator lever, which remains in said non-actuated position, in the tripped position of said operator handle.

6. The circuit breaker of claim 1 wherein the surface of said operator handle disengages from said actuator lever in the OFF position of said operator handle.

7. A circuit breaker comprising:

a housing;

at least one set of separable contacts including a set of main contacts;

an operating mechanism including an operator handle for opening and closing said set of main contacts, said operator handle having a surface, an ON position, a tripped position, and an OFF position, said main contacts being closed in said ON position, being open in said tripped position, and being open in said OFF position;

a trip mechanism releasing said operating mechanism to move said operator handle to said tripped position; and a switch including an actuator lever movable between an actuated position and a non-actuated position and adapted to engage the surface of the operator handle of said operating mechanism, said switch also including a contact having a first state corresponding to said actuated position and a second state corresponding to said non-actuated position, the surface of said operator handle engaging and moving said actuator lever to said actuated position in only the ON position of said operator handle, said actuator lever being in said non-actuated position in the OFF position and the tripped position of said operator handle;

wherein said at least one set of separable contacts includes said set of main contacts and a set of secondary contacts electrically connected in series with said set of main contacts; wherein said operating mechanism includes a solenoid moving said set of secondary contacts between closed and open positions, and a control circuit selectively energizing said solenoid; wherein said switch is a first switch; and wherein said control circuit includes a second switch having a first contact controlling said solenoid and a second contact electrically connected to the contact of said first switch; wherein the second contact of said second switch and the contact of said first switch are adapted to receive a voltage; wherein the second contact of said second switch has an output adapted to provide a feedback voltage external to said housing when said set of secondary contacts is closed; and wherein the contact of said first switch has an output adapted to provide a feedback voltage external to said housing when said set of main contacts is closed.

8. A circuit breaker comprising:

a housing;

at least one set of separable contacts including a set of main contacts;

an operating mechanism including an operator handle for opening and closing said set of main contacts, said operator handle having a surface, an ON position, a tripped position, and an OFF position, said main contacts being closed in said ON position, being open in said tripped position, and being open in said OFF position;

a trip mechanism releasing said operating mechanism to move said operator handle to said tripped position; and a switch including an actuator lever movable between an actuated position and a non-actuated position and adapted to engage the surface of the operator handle of said operating mechanism, said switch also including a contact having a first state corresponding to said actuated position and a second state corresponding to said non-actuated position, the surface of said operator handle engaging and moving said actuator lever to said actuated position in only the ON position of said operator handle, said actuator lever being in said non-actuated position in the OFF position and the tripped position of said operator handle;

wherein said at least one set of separable contacts includes said set of main contacts and a set of secondary contacts electrically connected in series with said set of main contacts; wherein said operating mechanism includes a solenoid moving said set of secondary contacts between closed and open positions, and a control circuit selectively energizing said solenoid; wherein said switch is a first switch; and wherein said control circuit includes a contact electrically connected in series with the contact of said first switch, a first node electrically connected to the contact of said first switch and to the contact of said control circuit, a second node, a first circuit element electrically connected between the contact of said first switch and said second node, and a second circuit element electrically connected between the contact of said control circuit and said second node.

9. The circuit breaker of claim 8 wherein said first circuit element is a first resistor having a first resistance value; and wherein said second circuit element is a second resistor having a different second resistance value.

10. The circuit breaker of claim 9 wherein the second resistance value is about two times the first resistance value.

11. A circuit breaker comprising:

a molded housing having a base portion and a cover portion;

separable contacts;

an operating mechanism including an operator handle for opening and closing said separable contacts, said operator handle having a surface, an ON position, a tripped position, and an OFF position, said separable contacts being closed in said ON position, being open in said tripped position, and being open in said OFF position;

a trip mechanism releasing said operating mechanism to move said operator handle to said tripped position; and a micro-switch including an actuator lever movable between an actuated position and a non-actuated position and adapted to engage the surface of the operator handle of said operating mechanism, said switch also including a contact having a first state corresponding to said actuated position and a second state corresponding to said non-actuated position, the surface of said operator handle engaging and moving said actuator lever to said actuated position in the ON position of said operator handle, said actuator lever being in said non-actuated position in the OFF position and the tripped position of said operator handle, said micro-switch having a first side, which engages the base portion of said molded housing, and an opposite second side, which engages said cover portion of said molded housing.

12. The circuit breaker of claim 11 wherein said micro-switch further has a third side, which is normal to the first and second sides of said micro-switch; and wherein the base portion of said molded housing includes a first surface, which engages the first side of said micro-switch, and a second surface, which is normal to said first surface and which engages the third side of said micro-switch.

13. The circuit breaker of claim 11 wherein the contact of said micro-switch has an input adapted to receive a voltage and an output adapted to provide a feedback voltage external to said housing when said separable contacts are closed.

* * * * *